US009982476B2

(12) United States Patent
Clarke, Jr. et al.

(10) Patent No.: US 9,982,476 B2
(45) Date of Patent: May 29, 2018

(54) ADJUSTABLE MULLION RECEPTACLE

(71) Applicant: Frame & Mullions LLC, Henrico, VA (US)

(72) Inventors: James Thomas Clarke, Jr., Henrico, VA (US); David Nelson Hamlet, Henrico, VA (US)

(73) Assignee: Frame & Mullions LLC, Henrico, VA (US)

( * ) Notice: Subject to any disclaimer, the term of this patent is extended or adjusted under 35 U.S.C. 154(b) by 0 days. days.

(21) Appl. No.: 15/403,416

(22) Filed: Jan. 11, 2017

(65) Prior Publication Data

US 2017/0204652 A1 Jul. 20, 2017

Related U.S. Application Data

(60) Provisional application No. 62/278,578, filed on Jan. 14, 2016.

(51) Int. Cl.
*E06B 1/52* (2006.01)
*E06B 3/36* (2006.01)

(52) U.S. Cl.
CPC ..... *E06B 1/524* (2013.01); *E06B 3/362* (2013.01); *E06B 3/365* (2013.01)

(58) Field of Classification Search
CPC ..... E06B 1/524; E06B 3/362; E06B 3/365; E05C 7/04
USPC ..... 49/365
See application file for complete search history.

(56) References Cited

U.S. PATENT DOCUMENTS 2,827,960 A * 3/1958 Keating et al. ..... B61D 19/002 160/370.1
5,450,697 A * 9/1995 Prucinsky ..... E06B 1/524 49/365
5,471,792 A * 12/1995 Higgins ..... E06B 1/524 292/219
5,794,382 A * 8/1998 Prucinsky ..... E06B 1/524 49/365
5,890,319 A * 4/1999 Haeck ..... E06B 1/524 49/365
6,427,387 B1 * 8/2002 Hunt ..... E06B 1/524 292/219
7,000,355 B2 * 2/2006 Flory ..... E06B 1/524 49/365
8,069,612 B2 * 12/2011 Lin ..... E05B 63/0017 49/365
8,079,178 B2 * 12/2011 Lin ..... E06B 1/524 49/365
8,082,695 B2 * 12/2011 Lin ..... E06B 1/524 49/365
8,136,300 B2 * 3/2012 Lin ..... E05B 63/242 292/219
2002/0053170 A1 * 5/2002 Hunt ..... E06B 1/524 49/365

(Continued)

*Primary Examiner* — Justin B Rephann
(74) *Attorney, Agent, or Firm* — John H. Thomas, P.C.

(57) ABSTRACT

An adjustable mullion receptacle includes a two-sided safety block adapted to sit in the well portion of the mullion receptacle. A receiving block face side of the block is adapted to fit into the hollow bottom of a hollow mullion tube. The opposite side of the block defines a smooth safety face that can be used to set in the receptacle well when the mullion is removed for any purpose. The block then fills the well and provides a smooth surface over the receptacle well.

6 Claims, 8 Drawing Sheets

(56) References Cited

U.S. PATENT DOCUMENTS

| | | | | |
|---|---|---|---|---|
| 2004/0182009 | A1* | 9/2004 | Flory | E06B 1/524 49/365 |
| 2011/0083368 | A1* | 4/2011 | Lin | E05B 65/104 49/7 |
| 2012/0110913 | A1* | 5/2012 | Greenfield | E06B 1/524 49/365 |
| 2017/0306688 | A1* | 10/2017 | Clarke, Jr. | E06B 1/524 |

* cited by examiner

ADJUSTABLE MULLION RECEPTACLE

The present application claims the benefit of filing of U.S. Provisional Patent Application No. 62/278,578, filed Jan. 14, 2016, and incorporated by reference herein in its entirety.

The invention is an adjustable removable mullion receptacle box that is flush mounted either directly into the floor or into a threshold at the center of an opening where a pair of doors meet. A removable mullion is a hollow rectangular steel or aluminum post that fits into the adjustable box behind the doors in a building or room and is locked or fastened into place to the frame header at the top of the mullion. The mullion can be temporarily removed when a wider opening is needed.

Additionally, the receptacle assembly includes a two-sided safety block. One side is machined for use when installing the mullion into its fixed vertical position. The opposite side is a smooth top for the receptacle box. When the mullion is removed from a building/room opening, the block is flipped over in the receptacle box to serve as a safety block to avoid having the receptacle box become a trip hazard in the opening. The invention replaces the traditional fixed sill block used to anchor the bottom of a conventional mullion to the floor or a threshold. Traditional

BACKGROUND

Many types of doors and hardware are used in hard traffic, commercial, institutional, and industrial door openings in buildings. When trying to achieve a specific function and design for an opening, the factors of aesthetics, security, safety, and resistance to abuse must be considered. Often, when double doors are installed at a particular location, a necessary piece of hardware is a center mullion. Depending on the design and function of the opening, a mullion may be permanently fixed in place to secure the doors, or the mullion can be engineered so that it is removable, for example with a key. Unfortunately, some mullions, especially electric mullions, that use electric strikes to secure an opening, are difficult to remove and reinstall. A second issue concerns the mullion sill block. A removable mullion that is locked in place to a header block at the top of the mullion, has a sill block at the bottom. It is fixed either to the floor, or the top of the threshold, and is concealed as it projects upward inside the bottom of the mullion tube. When the mullion is removed, the block is exposed and becomes a fixed projection that is a trip hazard in the opening. In this mode the block is easily dislodged or damaged when large, heavy objects have to be moved through the opening. It then has to be reattached or replaced in order to reinstall the mullion and lock the doors. The doors cannot be secured without having the mullion in place.

SUMMARY

Accordingly, it is an object of the present invention to overcome the challenges and limitations with prior art mullion receptacles and sill blocks.

In one example, an adjustable mullion receptacle comprises a generally rectangular well having a first length and width and having side and back flanges connected to a top edge of the well and having a first thickness. The receptacle also comprises a two-faced safety block with a receiving block face and a smooth safety face. The receiving block face comprises a substantially rectangular protrusion having a first length and width adapted to fit inside a hollow mullion tube, and a bottom flange around the block and having a second length and width that is larger than the first length and width of the protrusion and that is adapted to be about the same length and width as an outside diameter of the hollow mullion tube. The smooth safety face has a substantially rectangular shape that is substantially the same as or less than the first length and width as the receptacle well and is further adapted to fit flush with the receptacle flange surfaces, whereby the adjustable, two-faced safety block may alternatively function as a receiving block or as a smooth block to fill the receptacle well. The adjustable, two-faced safety block may further comprise a plurality of threaded set screw holes, in one example four set screw holes positioned proximate the four corners of the rectangular safety block, the set screw holes disposed through the thickness of the block and open to the receiving block face and to the smooth safety face, and the block further comprising set screws in the plurality of threaded set screw holes. The set screws may be threaded to extend outwardly from the receiving block face or the smooth safety face or fully inside the thickness of the block so that the block may be optionally tilted within the receptacle well. Also, the receptacle may comprise a removable front flange having substantially the same width as the receptacle and having substantially the same thickness as the side and back flanges of the receptacle.

In another example, an adjustable mullion receptacle as described above may be provided in combination with a mullion, wherein the mullion comprises a hollow rectangular tube having a cross-sectional length and width in its inside and outside dimensions to fit over the receiving block face and be supported on the bottom flange around the receiving block face.

BRIEF DESCRIPTION OF THE DRAWINGS

FIGS. 2A and B show step 1 of a typical installation process.

FIGS. 3A and B show step 2 of the installation process.

FIGS. 5A and B show the receptacle set in its lowest fixed position.

DETAILED DESCRIPTION

Figure 1A:
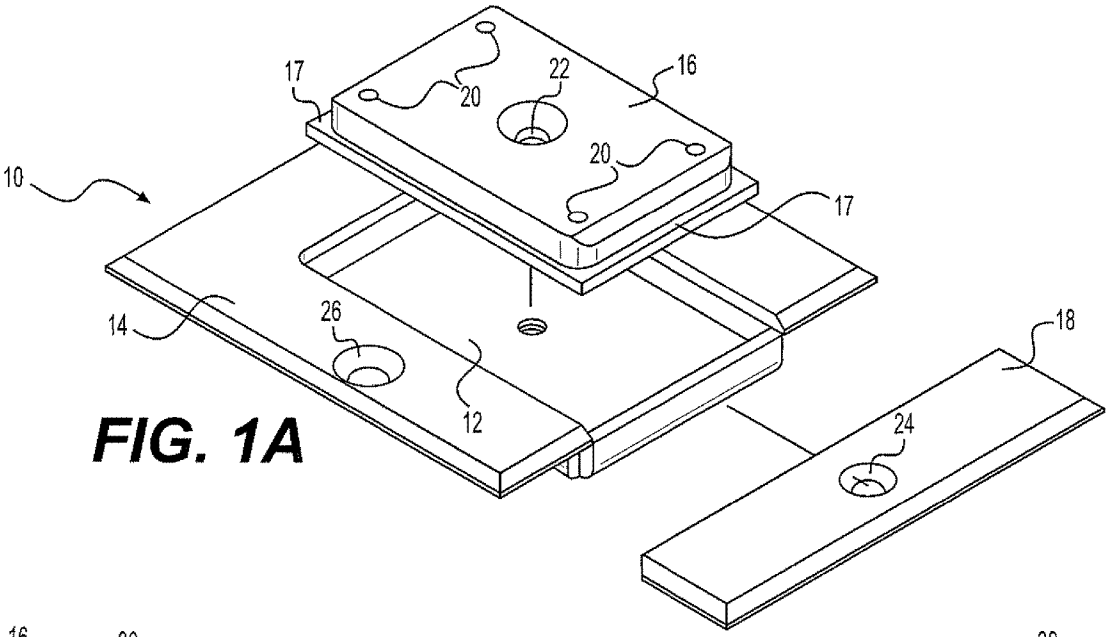
FIGS. 1A-1C are a collection of exploded views of an example of the mullion receptacle described herein. There are perspective FIG. 1A, side FIG. 1B, and front FIG. 1C views of the mullion receptacle.

When a steel mullion is permanently installed in a door way with a hollow metal frame it is typically welded to the header at the top and secured to the concrete slab at the bottom. If the aluminum mullion is installed in an aluminum storefront or curtain wall system there are two ways it may be permanently installed depending on the design of the building. First, when there is no additional frame structure above the header, the mullion is fixed to the underside of the frame header at its top and to the concrete slab at the bottom. The other is when the mullion is a part of an aluminum and glass frame structure that extends upward beyond the top of the frame header. In this case the fixed mullion tube will usually extend up through the header, and other horizontal frame members, and is secured at the top of the opening. At the bottom, the mullion is secured to the concrete slab. In both cases the mullions are permanent and are not designed to be removed.

When a wider opening is needed, a keyed removable mullion can be used so it can be temporarily removed to allow large objects to pass through the door opening. The mullion receptacle described herein is designed to replace a conventional, fixed sill block as a method of securing the bottom of the mullion in place. When the adjustable mullion receptacle box is installed, it receives the base of the mullion. Then the top of the mullion is tilted into its fixed vertical position and locked into place, in one example, around a head block or into a fixture mounted on the underside of the frame header.

In the installation process, the mullion is cut in the field to the proper length, placed in the receptacle, and tilted into its fixed vertical position. The rectangular geometry of the mullion requires that when the top is tilted into its fixed vertical position it must be shorter on its leading edge than the distance between the bottom of the receptacle box and the underside of the frame header. Otherwise, the leading edge of the mullion will not pass the front corner at the underside of the rectangular header tube when it is tilted into place.

Traditionally, a mullion is square cut at the bottom with clearance allowed so it is short enough to clear the header. However this results in there being an undesirable gap at the top of the mullion after it is installed. To correct this problem, the bottom of the mullion can be cut at an angle across the bottom of the mullion. The cut is calculated and made so that it starts on the edge of the mullion that faces the inside the building and proceeds across the bottom of the mullion to the opposite corner of the mullion. The angled cut should start at a point that will make the top of the mullion short enough at its leading edge to clear the header when it is tilted into place.

However this procedure requires a very precise cut and if not done properly it will result in a gap between the top of the mullion and the underside of the header. The adjustable mullion receptacle features described herein allow the bottom of the mullion to be square cut in the field and installed in a way that avoids all these issues.

Figure 7A:
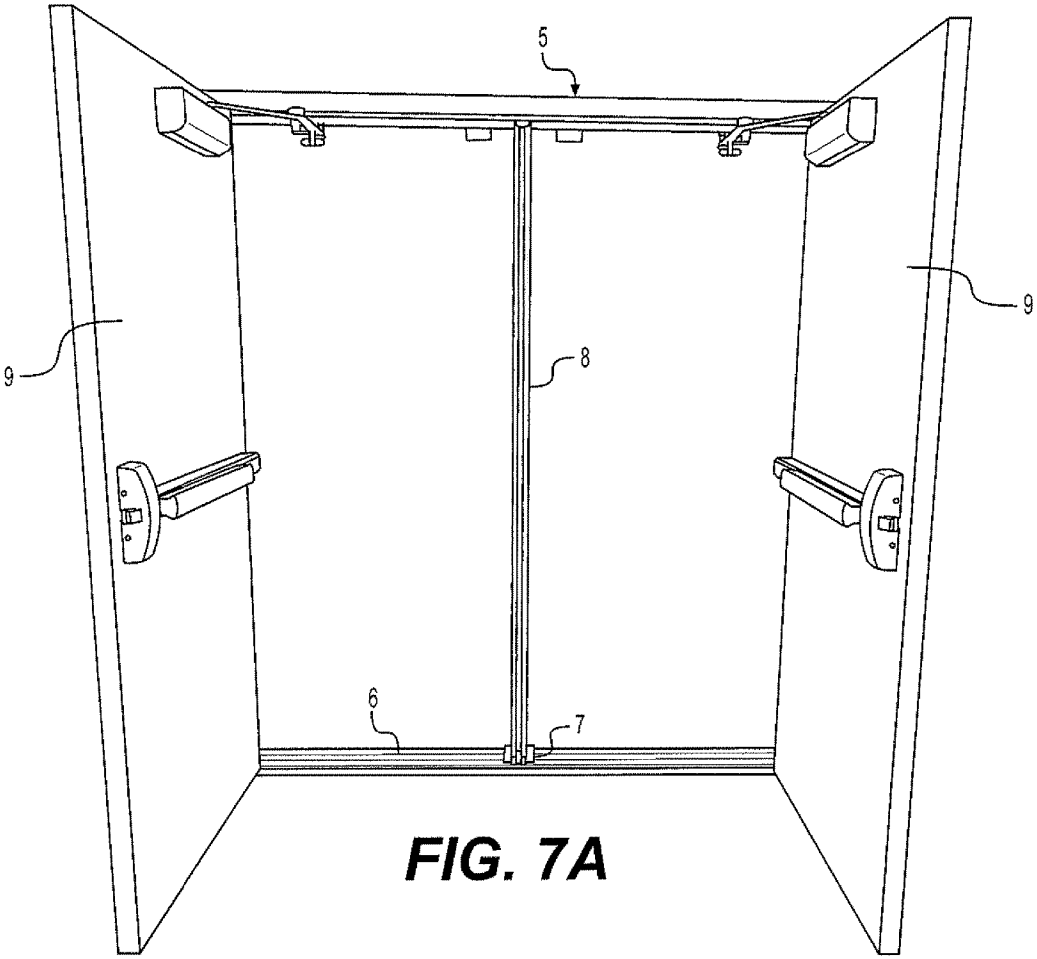
FIGS. 7A and B are environmental perspective views of a doorway system where the mullion described herein may be used.
Figure 7B:
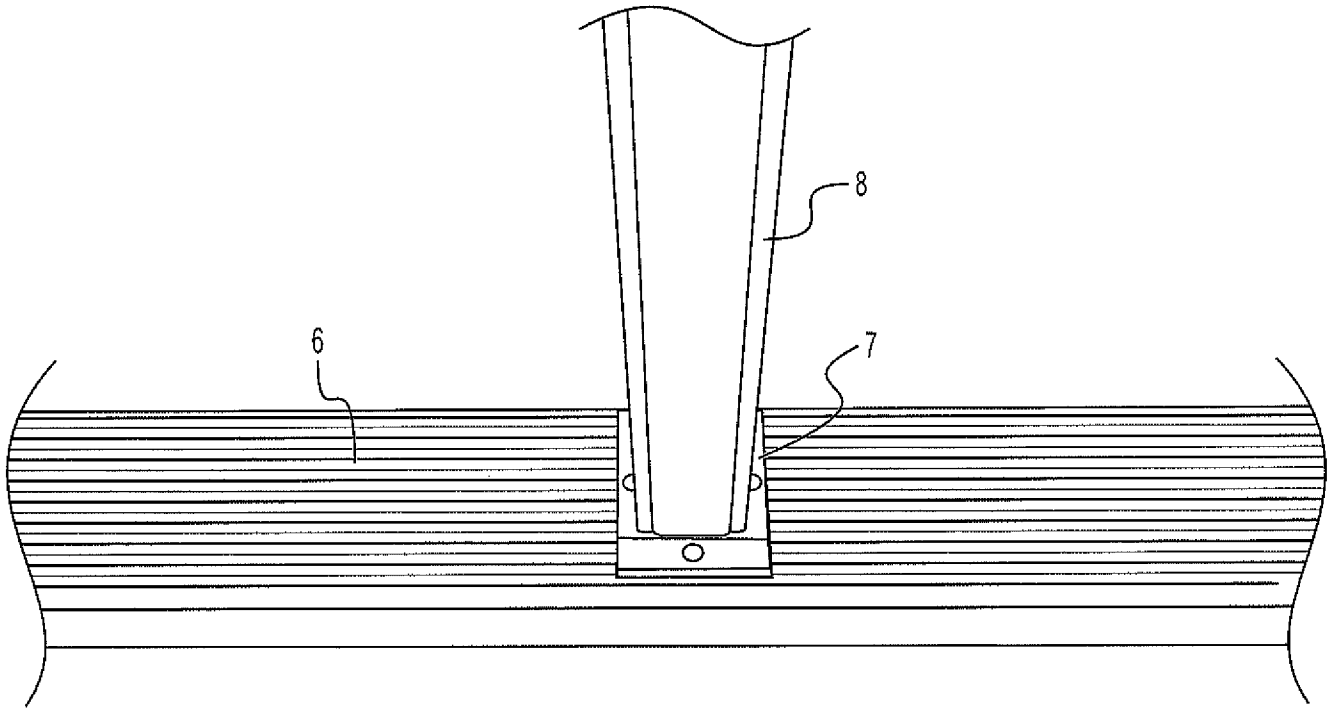

FIGS. 7 A and B illustrate generally one example of a doorway 5 with a threshold 6 in which is mounted the adjustable mullion receptacle 7 described herein. There are two doors 9 with the mullion 8 disposed between them. The mullion 8 is placed into the receptacle 7 mounted in the threshold 6 and then is also secured at its top at the top of the doorway 5.

FIGS. 1-6 illustrate one embodiment of an adjustable mullion receptacle with features that will allow the bottom of the mullion to be square cut, because a needed angle can be achieved by making adjustments to the adjustable safety block in the receptacle box instead. Micro adjustments can then be made by using the set screws 21 to raise or lower the mullion 40, without changing the angle of the block. This will enable the mullion to be adjusted to fit in place under the frame header with minimal clearance between the top of the mullion and the underside of the header.

The cost of replacing a mullion and the related costs of time delays in the construction process is avoided by the use of the receptacle described herein. It will prevent costly mistakes in the installation process and delays in installation time if a mullion is cut too short and a new one would otherwise have to be ordered.

Though the receptacle and adjustable block are unconventional, the rectangular construction of the mullion illustrated in the figures is believed to be relatively conventional. The receptacle must be constructed so that the internal dimensions of the rectangular receptacle will allow enough clearance to properly receive the mullion.

Figure 1B:
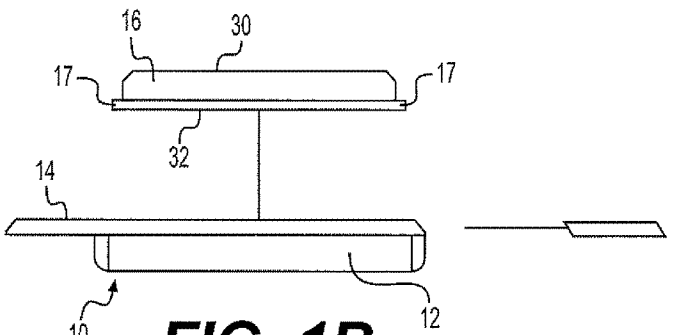
Figure 1C:
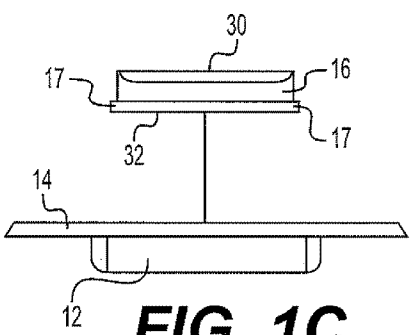

Turning to FIG. 1 with views A, B, and C, receptacle 10 includes a receptacle box 12 and, a perimeter flange 14 forming a u-shaped collar around the sides and back of the receptacle box 12. There is also a front receptacle flange 18. Placed inside the receptacle box 12 is the adjustable safety block 16. In FIG. 1, the safety block is shown with the receiving block face 30 oriented upwardly. This block face 16 has perimeter dimensions on the top side that allow it to be received inside the rectangular tube of a mullion that is mounted over it. The bottom portion of the block face 16 is machined to create a flange 17 that the bottom of the mullion will bear onto for support when it is in its fixed vertical position.

The adjustable safety block 16 has a fixed position screw hole 22 in its center that will allow a flat head screw to secure the block in place when it is flipped over to its safety position. The block also has adjustable set screw threaded holes 20 in its corners. The receptacle flanges 14 include mounting screw holes 26 on each side.

The removable front receptacle flange 18 includes a mounting screw hole 24. After being opened, the pair of doors swing shut and come to rest against the mullion over the top of the front flange 18. Should the doors drag on it when closing, the flange 18 can be removed to allow for more clearance under the doors.

The back edge of the flange 18 and the front ends of a receptacle perimeter flange legs 14 are beveled in opposite directions to allow them to fit together so the two bevels are not seen. If flange 18 is removed, the front ends of the flange legs will present a more finished appearance when beveled than if they were square cut. In FIG. 1, the smooth safety face 32 of the adjustable safety block 16 is positioned so it faces the bottom of the receptacle box 12.

Figure 2A:
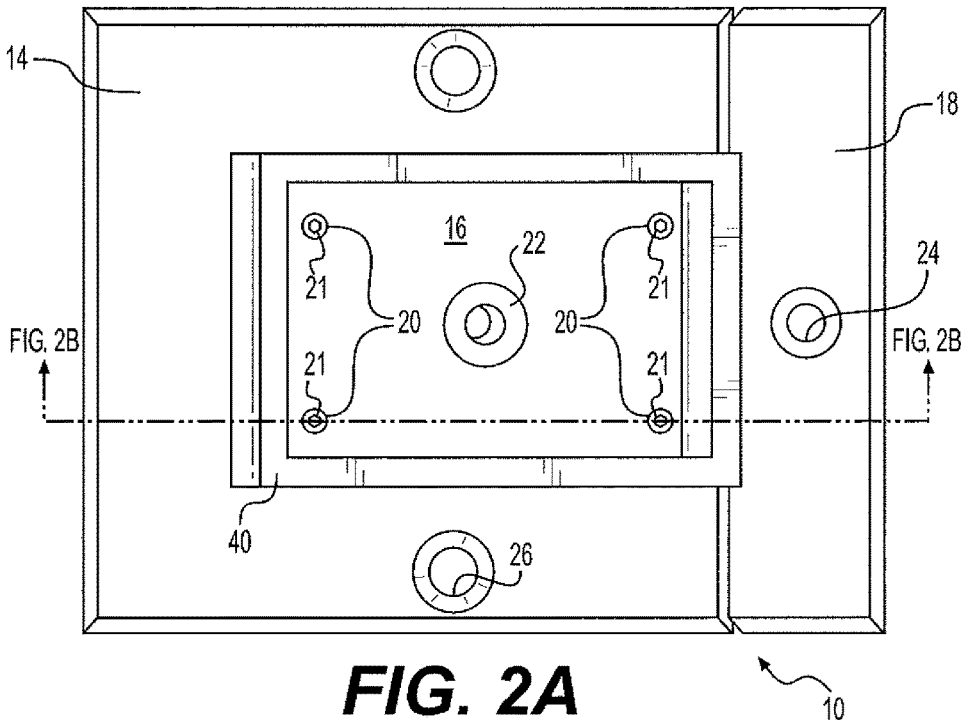
FIGS. 2A and B are top view FIG. 2A and side cross-sectional view FIG. 2B of a mullion receptacle as described herein.
Figure 2B:
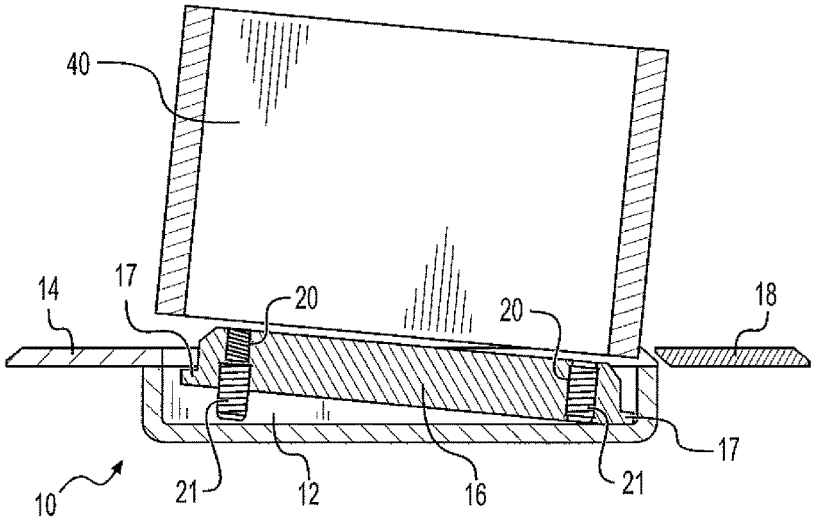
Figure 3A:
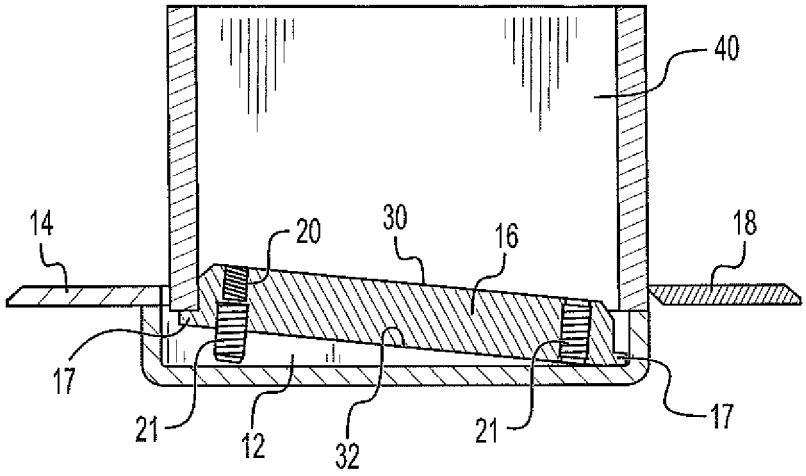
FIGS. 3A and B are a side view FIG. 3A and perspective cross-sectional view FIG. 3B of a mullion described herein.
Figure 3B:
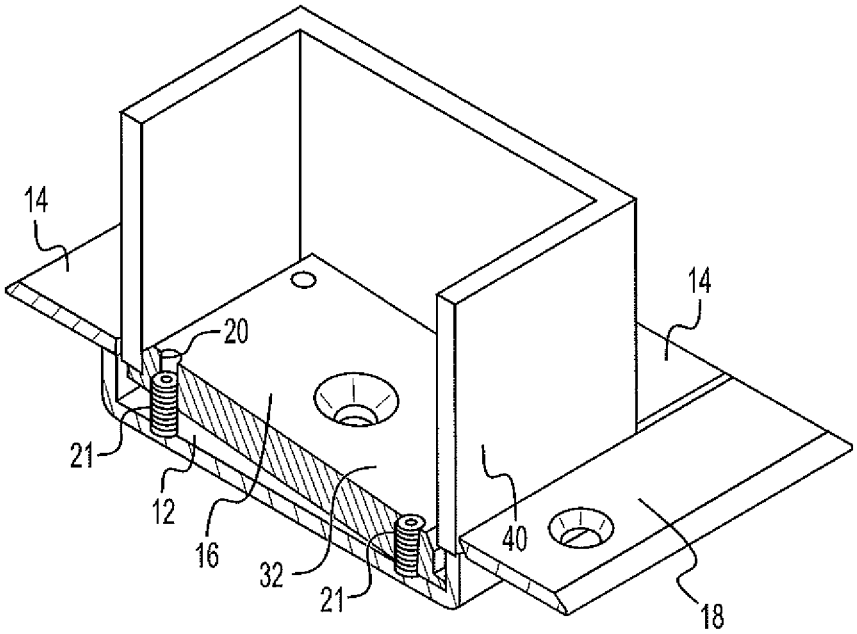

Turning to FIGS. 2A and B, the bottom portion of mullion 40 is shown and has a tubular rectangular shape. The mullion 40 is mounted onto and around the adjustable safety block 16 in receptacle 10, and bears onto the flange 17 on the bottom of the block 16 under the mullion 40. The top portion of the adjustable safety block 16 fits inside the bottom of mullion 40. It keeps the mullion from moving forward if the front flange 18 were to be removed as described above.

As seen in FIGS. 2A and B, the adjustable safety block 16 has four adjustable screws 21 positioned in the set screw holes 20. Two front screws 21 are shown in their retracted positions and are fully within the body or thickness of the safety block 16. The two back screws 21, however, are shown extending from the smooth safety face 32 of the adjustable safety block 16 to give an inclined mounting position that can secure the bottom of the mullion 40 in receptacle box 12.

FIGS. 2A and B shows step 1 of the installation procedure where the mullion is positioned in place over the mounting block 16. The presence of safety block 16 in this tilted position eliminates the need to make an angle cut in the field at the bottom of mullion 40, to provide for clearance at the header when the mullion is installed Turning to FIGS. 3A and B, step 2 of the installation procedure is shown. The mullion 40 has been tilted into place and is resting on and is supported by the flange 17 at the bottom of safety block 16. The back edge of the mullion 40 is secured in place by the projection of the top portion of adjustable safety block 16 into the bottom of mullion 40. In this way, the safety block 16 can be adjusted vertically so that mullion 40 is in position with a minimal amount of clearance where the mullion top intersects with the underside of the header.

Figure 4A:
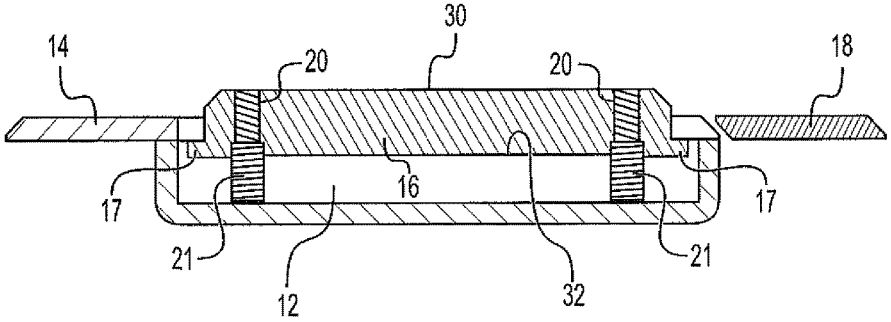
FIGS. 4A and B are a side view FIG. 4A and perspective cross-sectional view FIG. 4B of an adjustable mullion adjusted to its highest fixed position.
Figure 4B:
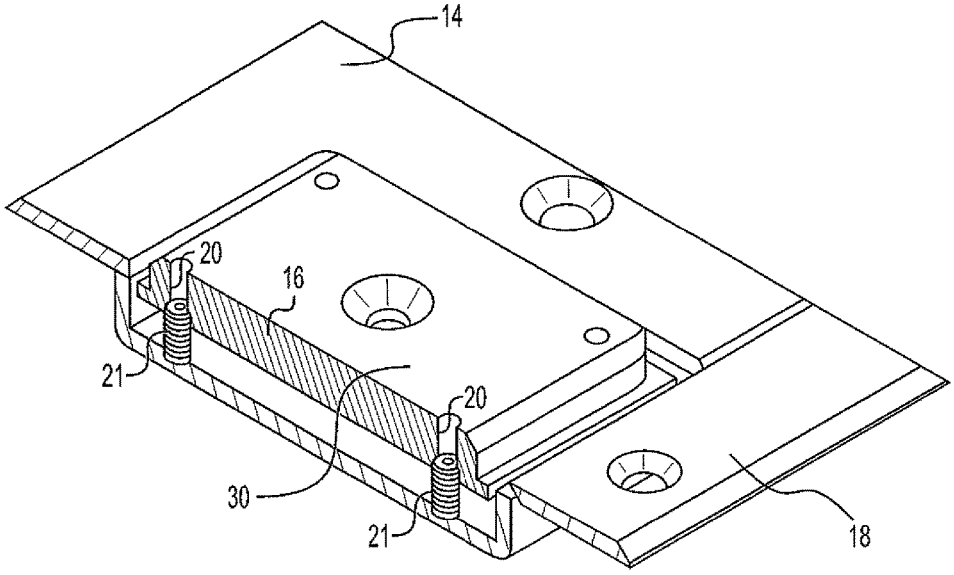

FIGS. 4A and B are an illustration of the receptacle 10 when the mullion has been removed to show the adjustable safety block when raised to its highest fixed position. Both of the adjustable screws 21 are shown extending out from the smooth safety face 32 of the safety block 16 to raise the block.

Depending on the construction and installation of a particular mullion in a doorway, this height of the safety block 16 can be variably moved upwardly and downwardly as mentioned above by threading or unthreading of the adjustable screws 21 in the adjustable screw holes 20.

Figure 5A:
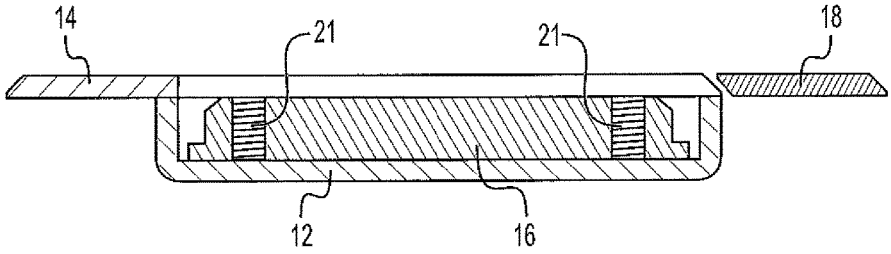
FIGS. 5A and B are a side view FIG. 5A and perspective cross-sectional view FIG. 5B of a mullion receptacle described herein.
Figure 5B:
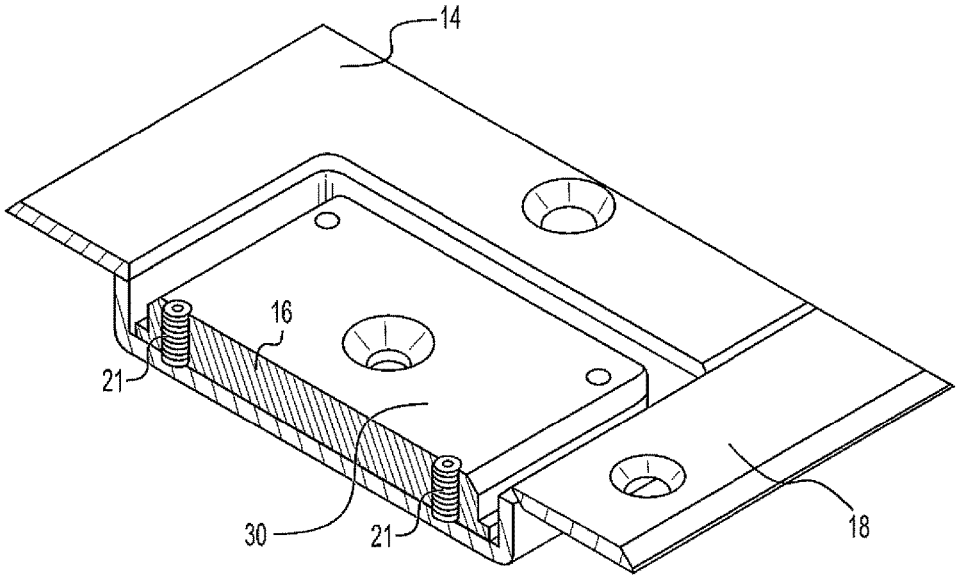

FIGS. 5A and B shows-the safety block 16 in its fixed lowest position. In this position, the safety block 16 sits fully within the receptacle box 12. The threaded screws 21 are fully retracted into the threaded holes 20 of the safety block 16. Any adjustable height between the lowest position, FIG. 5, and highest position, FIG. 4, can be made be on site, by manipulating the screws. Also in this manner adjustments can be made that change the degree of the angle of the adjustable plate.

Figure 6C:
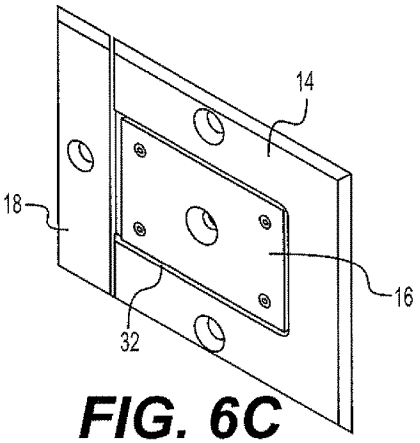
FIGS. 6A-C are a top view FIG. 6A, side cross-sectional view FIG. 6B and perspective view FIG. 6C of a mullion receptacle with the safety block face shown installed in the receptacle.
Figure 6A:
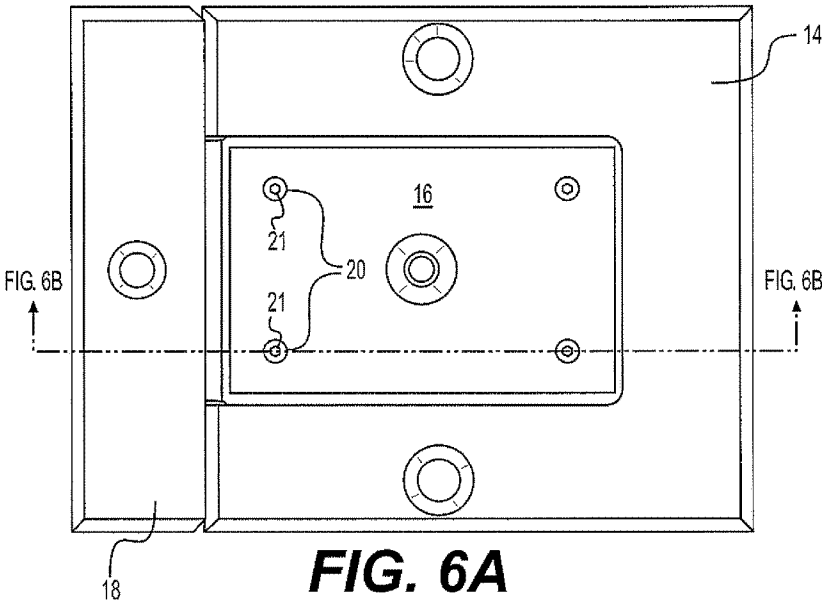
Figure 6B:
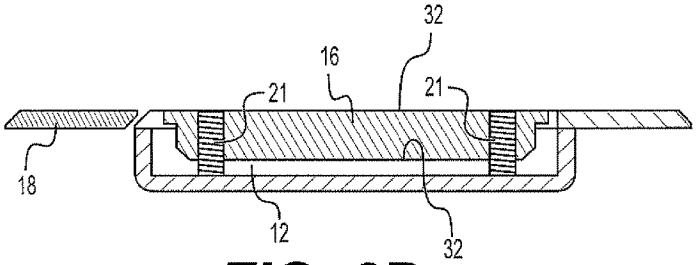

FIGS. 6A-C show the adjustable safety block 16, when it is flush with the top of the flanges and the smooth safety side 32 is on top of the safety block 16 and exposed upwardly. As noted earlier, there may be times when the mullion is removed so that large items may be moved in and out of an opening. In that case, the rectangular depression in the receptacle 12 becomes a nuisance or a hazard to persons walking through the door way. Accordingly, the safety block 16 is turned over so that the flat safety side 32 of the safety block 16 is exposed on top. This safety surface 32 is smooth and flat and is sized in width and length to be the same as or slightly less than receptacle well opening and to substantially cover the top of the receptacle box 12. In this way, a smooth surface is presented that eliminates the likelihood of high heels getting stuck in the receptacle. It also eliminates the liability issues associated with conventional removable mullion sill blocks that are a trip hazard projecting up into the doorway opening.

The receptacle described herein may also be used by itself in openings where there is no threshold, such as those found in the interior of buildings. Or, it can be used at exterior doors as a component of an assembly. However when used as an assembly, a specific threshold must be used so it can be engineered to accommodate the installation of the adjustable mullion receptacle into its face. In one example, the assembly requires a threshold that is ½" high×¼" thick× 7½" wide. In order to comply with one example of handicap code height restrictions, a threshold cannot exceed ½" in height. Accordingly, this example of a threshold is made so it has a ¼" clearance under it that will allow the adjustable mullion receptacle to be installed without having to remove any concrete beneath it.

The mullion receptacle is machined and engineered so that it fits right onto the top face of the threshold. The rectangular cutout in the threshold is made with enough clearances around its perimeter of the so it can be moved in any one of four directions. This will allow the mullion to be properly positioned plumb, and square in the opening. Once it is properly positioned, the mullion receptacle can be anchored to the floor with # 12 flat phillips head stainless steel screws and plastic anchors. Through holes drilled in the threshold will allow the screws to pass through the flanges and threshold to secure the receptacle to the floor for permanent installation.

A second reason for a particular heavy duty threshold is that the relative thickness of ¼" or (0.250) of the aluminum keeps it from being crushed when heavy equipment is brought through the opening. Conventional commercial threshold thicknesses in the industry vary from being about 0.105 to 0.188 inches thick. Also, this ¼" thickness is available so the mounting holes for the flanges will have enough thread depth to hold the receptacle securely in place as alternate method of installation.

In interior openings where no thresholds are required, the receptacle box described herein will have to be installed into a shallow rectangular pocket in the concrete floor with, for instance, the 3⁄16" thick flanges resting on the surface of the floor. Since the slab has already been poured, a shallow rectangular hole for the box has to be cut into the concrete. Then holes for the flange screws can be drilled into the concrete so the receptacle can be mounted to the floor with plastic anchors and stainless sheet metal screws. If the floor covering is to be vinyl tile, it can be laid up to the edges of the perimeter flanges making the receptacle nearly flush with the floor covering. If the floor covering is carpet, it can be laid so the carpet is under the flanges. Where there is no floor covering when something like terrazzo, slate or quarry tile is used the flanges will sit directly on the surface of the floor as described above for concrete.

The perimeter dimensions of the part of the safety block that projects up into the mullion, varies according to the mullion type specified for a particular job. For instance, one manufacturer's 2"×3" mullion can have a different wall thickness than another manufacturer's mullion. The thicker the mullion walls, the smaller the perimeter dimension of the projection on the safety block must be in order for it to fit up into the bottom of the mullion 40.

The adjustable mullion receptacle can be manufactured from any suitable materials. This may include heavy duty polymers or composite materials. The receptacle may be fabricated from aluminum, steel or other metal products and alloys.

Other embodiments of the present invention will be apparent to those skilled in the art from consideration of the specification. It is intended that the specification and figures be considered as exemplary only, with a true scope and spirit of the invention being indicated by the claims.

That which is claimed is:

1. An adjustable mullion receptacle comprising a generally rectangular well having a first length and width and having side and back flanges connected to a top edge of the well and having a first thickness, and the side and back flanges having respective side and back flange top surfaces;

a two-faced safety block with a receiving block face and a smooth safety face;

wherein the receiving block face comprises a substantially rectangular protrusion having a second length and width adapted to fit inside a hollow mullion tube, and a bottom flange around the block and having a third length and width that is larger than the second length and width and that is adapted to be about the same length and width as an outside diameter of the hollow mullion tube;

wherein the smooth safety face has a substantially rectangular shape that is substantially the same as or less than the first length and width of the receptacle well and is further adapted to fit flush with the side and back flange top surfaces;

whereby, the two-faced safety block may alternatively function as a receiving block or as a smooth block to fill the receptacle well.

2. An adjustable mullion receptacle as described in claim 1, wherein the two-faced safety block further comprises a plurality of threaded set screw holes disposed therein through the thickness of the block and open to the receiving block face and the smooth safety face and on opposite ends of the block, and the block further comprising set screws in the plurality of threaded set screw holes;

whereby the set screws may be threaded to extend outwardly from the receiving block face or the smooth safety face or fully inside the thickness of the block so that the block may be optionally tilted within the receptacle well.

3. An adjustable mullion receptacle as described in claim 2, wherein the plurality of threaded screw holes are four set screw holes with set screws positioned therein, and the set screw holes are positioned proximate the four corners of the rectangular safety block.

4. An adjustable mullion receptacle as described in claim 1, further comprising a removable front flange having substantially the same width as the receptacle and having substantially the same thickness as the side and back flanges of the receptacle.

5. An adjustable mullion receptacle as described in claim 1, wherein the adjustable, two faced safety block further comprises an anchor screw hole therethrough and an anchor screw; and wherein the receptacle well comprises a threaded hole in the bottom thereof that is positioned corresponding to the anchor screw hole to allow the anchor screw to extend through the anchor screw hole and be secured in the receptacle well threaded hole to removably fix the block in the receptacle well.

6. An adjustable mullion receptacle as described in claim 1, in combination with the hollow mullion tube, wherein the hollow mullion tube comprises a hollow rectangular tube having a first cross-sectional length and width in its inside dimensions and is adapted to fit over the receiving block face and be supported on the bottom flange around the receiving block.

* * * * *